US011149695B1

(12) United States Patent
Lee

(10) Patent No.: US 11,149,695 B1
(45) Date of Patent: Oct. 19, 2021

(54) ENGINE INTAKE SYSTEM OF VEHICLE

(71) Applicants: Hyundai Motor Company, Seoul (KR); Kia Motors Corporation, Seoul (KR)

(72) Inventor: Jun Hee Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/075,219

(22) Filed: Oct. 20, 2020

(30) Foreign Application Priority Data

Jul. 8, 2020 (KR) ..... 10-2020-0084033

(51) Int. Cl.

| | |
|---|---|
| ***F02M 26/05*** | (2016.01) |
| ***F02M 26/23*** | (2016.01) |
| *F02M 26/35* | (2016.01) |
| *F02M 26/19* | (2016.01) |

(52) U.S. Cl.
CPC ..... *F02M 26/05* (2016.02); *F02M 26/23* (2016.02); *F02M 26/19* (2016.02); *F02M 26/35* (2016.02)

(58) Field of Classification Search
CPC ..... F02M 26/05; F02M 26/23; F02M 26/19; F02M 26/35
See application file for complete search history.

(56) References Cited

U.S. PATENT DOCUMENTS

| | | | | |
|---|---|---|---|---|
| 2017/0306898 | A1* | 10/2017 | Kim | F02D 41/0065 |
| 2017/0314517 | A1* | 11/2017 | Kim | F02M 26/35 |
| 2017/0328263 | A1* | 11/2017 | Uhrich | F02M 26/06 |
| 2019/0003379 | A1* | 1/2019 | Kemmerling | F02M 26/09 |
| 2019/0376461 | A1* | 12/2019 | Martz | F02D 41/068 |

FOREIGN PATENT DOCUMENTS

| | | |
|---|---|---|
| KR | 2017-0068104 A | 6/2017 |

* cited by examiner

*Primary Examiner* — Xiao En Mo
(74) *Attorney, Agent, or Firm* — Mintz Levin Cohn Ferris Glovsky and Popeo, P.C.; Peter F. Corless

(57) ABSTRACT

A compressor inlet pipe is installed to connect an EGR valve to an inlet of a compressor of a charger and is made of a thermally conductive material. A gas pocket is formed at the compressor inlet pipe and a gas supply device is configured to draw gas from an outlet of the compressor of the charger and supply the gas to the gas pocket. A gas discharge device is configured to discharge the gas in the gas pocket.

15 Claims, 11 Drawing Sheets

ENGINE INTAKE SYSTEM OF VEHICLE

CROSS REFERENCE TO RELATED APPLICATION

The present application claims priority to Korean Patent Application No. 10-2020-0084033, filed on Jul. 8, 2020, the entire contents of which is incorporated herein for all purposes by this reference.

BACKGROUND

1. Field of the Disclosure

The present disclosure relates to an engine intake system of a vehicle and, more specifically, to a technology regarding an intake system including a charger.

2. Description of the Prior Art

A charger for an engine is used to compress air and supply the compressed air to a combustion chamber to improve the charging efficiency of the engine and thereby increase engine power. The charger may be categorized as a turbocharger, driven using exhaust gas discharged from an engine, and a supercharger, driven by a separate power source such as a motor or the like. In many cases, an engine includes an exhaust gas recirculation (EGR) device for recirculating a portion of exhaust gas to a combustion chamber through an engine intake system to reduce the discharge of nitrogen oxide and improve fuel efficiency.

Further, blow-by gas generated in an engine may be combusted in a combustion chamber through the engine intake system. A substantial amount of vapor is contained in the EGR gas and blow-by gas, which are recirculated through the EGR device. Therefore, when the temperature outside a vehicle is below zero, the vapor may freeze on a part in which fresh air suctioned into the engine intake system meets the EGR gas and the blow-by gas and is mixed therewith. In particular, a valve flap of an EGR valve for adjusting the amount of EGR gas may be difficult to operate due to the freezing of vapor, and when particles of frozen vapor are dropped and suctioned into a compressor of a charger, a compressor wheel may be damaged.

The above information disclosed in this section is merely for enhancement of understanding of the background of the present disclosure, and should not be taken as acknowledgement that this information forms the prior art already known to a person skilled in the art.

SUMMARY

An aspect of the present disclosure provides an engine intake system of a vehicle, configured to prevent the reduction of operability of an EGR valve due to freezing of vapor in the engine intake system to ensure smooth operability, and to solve problems such as damage to a compressor of a charger by frozen particles.

In views of the above aspect, an engine intake system of a vehicle according to the present disclosure may include: a compressor inlet pipe, which is installed to connect an EGR valve to an inlet of a compressor of a charger and is made of a thermally conductive material; a gas pocket formed at the compressor inlet pipe; a gas supply device configured to draw gas from an outlet of the compressor of the charger and supply the gas to the gas pocket; and a gas discharge device configured to discharge the gas in the gas pocket.

The compressor inlet pipe may include a blow-by nipple formed integrally therewith to be supplied with blow-by gas through the blow-by nipple. The gas pocket of the compressor inlet pipe may be formed to have a cylindrical space extending in the longitudinal direction of the compressor inlet pipe while surrounding the outer circumferential surface of the compressor inlet pipe. A rubber hose may be interposed between the compressor inlet pipe and the EGR valve.

The gas supply device may include: a gas supply pipe that connects the outlet of the compressor to the gas pocket; and a supply valve installed to adjust the opening degree of the gas supply pipe. The gas discharge device may include a pressure valve installed to discharge a gas in the gas pocket when the inner pressure of the gas pocket is equal to or greater than a predetermined reference pressure. The gas discharge device may further include a gas recovery pipe installed to supply the gas discharged by the pressure valve to an inlet of an intercooler.

An intercooler inlet hose and an intercooler inlet pipe may be connected to the outlet of the compressor in sequence; and the gas recovery pipe may be connected to the intercooler inlet pipe. The compressor inlet pipe may be formed in an L-shape to connect a first end thereof to a compressor housing and connect a second end thereof to the EGR valve via a rubber hose.

Further, an engine intake system of a vehicle according to the present disclosure may include: an EGR valve which includes a first inlet through which fresh air is introduced, a second inlet through which EGR gas is introduced, an outlet through which gas obtained by mixing the fresh air and the EGR gas is discharged, and a valve flap configured to adjust the amount of the EGR gas that is mixed with the fresh air; a compressor inlet pipe installed to supply a compressor with the gas discharged from the outlet of the EGR valve; and a heater configured to heat the compressor inlet pipe using a gas compressed and discharged by the compressor.

The heater may include: a gas pocket provided at the compressor inlet pipe; and a gas supply pipe configured to supply the gas pocket with the gas compressed and discharged by the compressor. The engine intake system of the present disclosure may further include: a supply valve configured to regulate the gas supplied to the gas pocket through the gas supply pipe; and a controller configured to operate the supply valve based on the temperature outside the vehicle to prevent the EGR valve from freezing.

A pressure valve may be connected to the gas pocket and may be opened when the gas pressure inside the gas pocket is equal to or greater than a predetermined reference pressure. The pressure valve may include a discharge port through which a discharged gas is emitted into the atmosphere. A gas recovery pipe may be connected to the pressure valve to supply a discharged gas to an intercooler.

The present disclosure may prevent a reduction in the operability of an EGR valve due to freezing of vapor in an engine intake system to ensure smooth operability, and may prevent a compressor of a charger from being damaged by frozen particles. In other words, in the present disclosure, heat, generated during the process of compressing gas in a compressor, may be transferred to a gas pocket of a compressor inlet pipe adjacently connected to an EGR valve to heat the EGR valve and an area therearound, and thus vapor contained in EGR gas or the like may be prevented from freezing inside or around the EGR valve.

When vapor is prevented from freezing inside and around the EGR valve as described, the accuracy of engine control may be increased by smooth operation of the EGR valve to improve engine power and reduce the discharge of harmful exhaust materials. Further, frozen particles may be prevented from colliding with a compressor wheel, and thus the durability of a charger may be increased.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION

Figure 1:
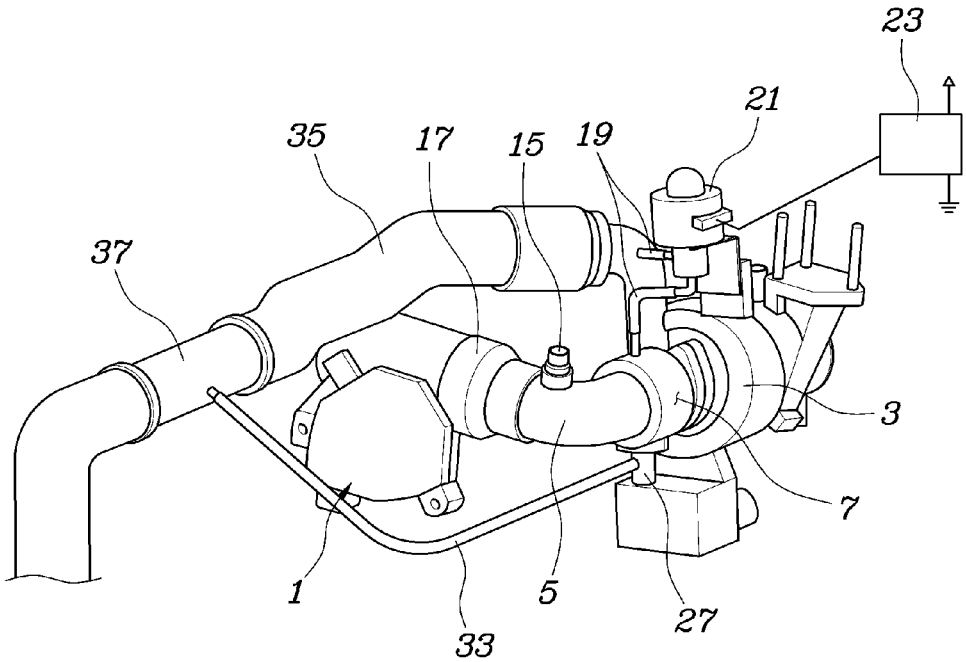
FIG. 1 illustrates the configuration of an engine intake system of a vehicle according to the present disclosure.
Figure 2:
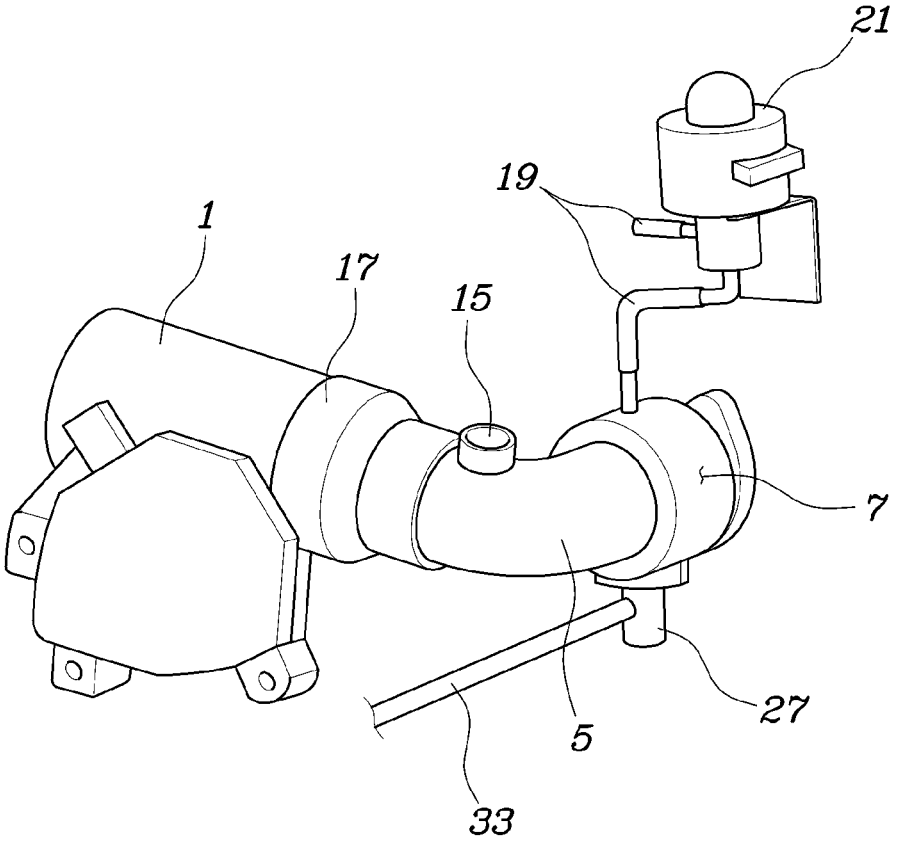
FIG. 2 illustrates important components constituting the present disclosure in FIG. 1 according to the present disclosure.
Figure 3:
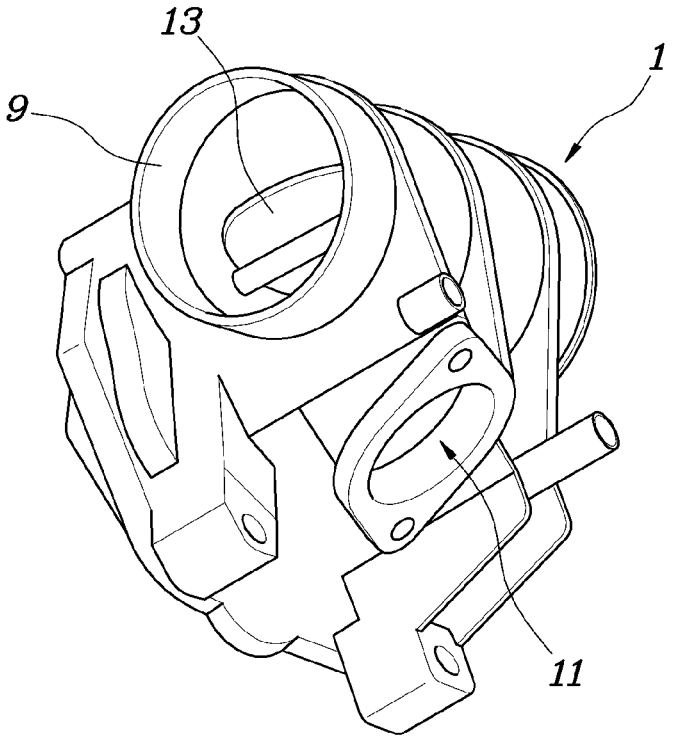
FIG. 3 illustrates an EGR valve according to the present disclosure.
Figure 4:
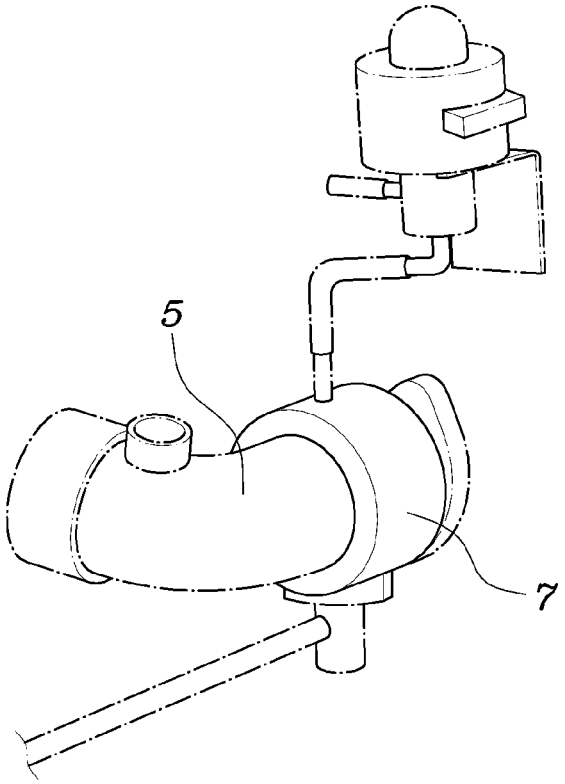
FIG. 4 illustrates the structure of a gas pocket according to the present disclosure.
Figure 5:
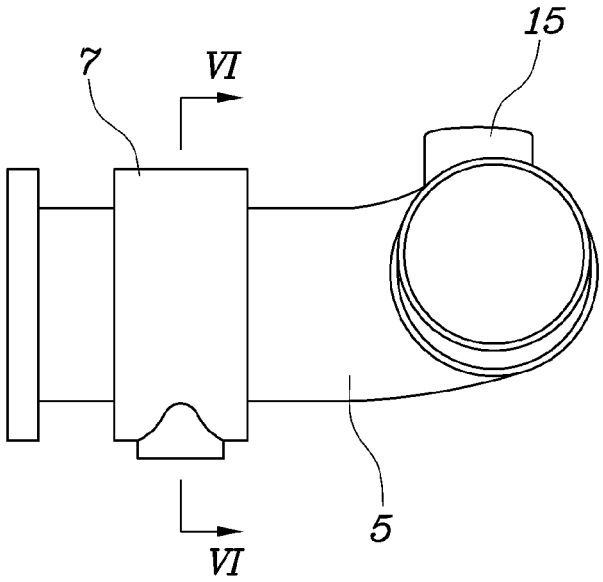
FIG. 5 illustrates a compressor inlet pipe according to the present disclosure.
Figure 6:
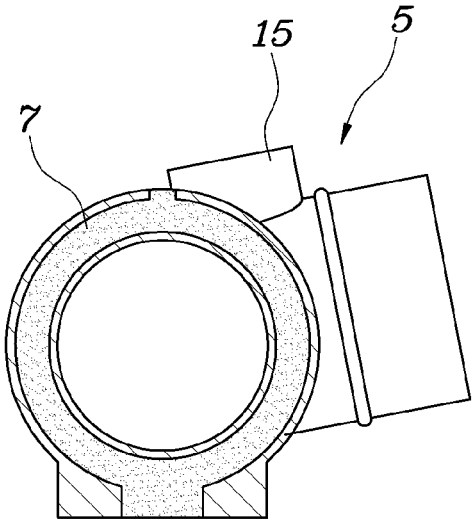
FIG. 6 is a cross-sectional view taken along line VI-VI of FIG. 5 according to the present disclosure.
Figure 7:
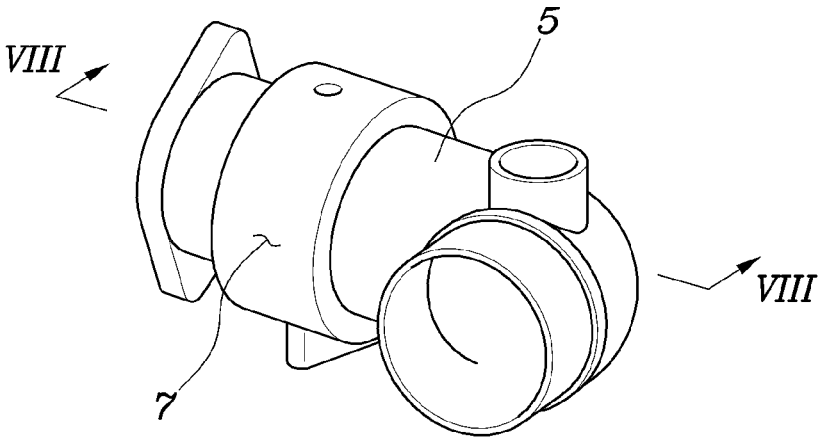
FIG. 7 illustrates a compressor inlet pipe from another angle according to the present disclosure.
Figure 8:
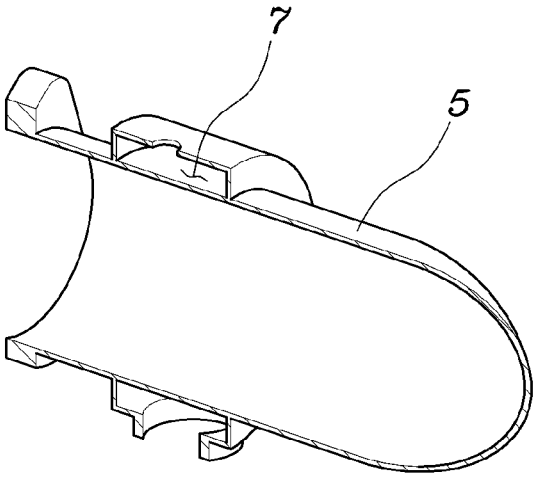
FIG. 8 is a cross-sectional view taken along line VIII-VIII of FIG. 7 according to the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Referring to FIGS. 1 to 8, an exemplary embodiment of an engine intake system of a vehicle according to the present disclosure may include: a compressor inlet pipe 5 installed to connect an EGR valve 1 to an inlet of a compressor 3 of a charger and made of a thermally conductive material; a gas pocket 7 formed at the compressor inlet pipe 5; a gas supply device configured to draw a gas from an outlet of the compressor 3 of the charger and supply the gas to the gas pocket 7; and a gas discharge device configured to discharge the gas in the gas pocket 7.

According to the present disclosure, a gas compressed and heated in the compressor 3 may be supplied to the gas pocket 7 to heat the compressor inlet pipe 5, and heat transferred by the compressor inlet pipe 5 is conducted to the EGR valve 1 to prevent vapor from freezing inside the EGR valve 1. Therefore, it is preferable that the compressor inlet pipe 5 be made of a material such as aluminum, having excellent thermal conductivity. The thermally conductive material used for the compressor inlet pipe 5 has better thermal conductivity than plastic resin generally used for a conventional engine intake pipe, and thus refers to a material that has the same thermal conductivity as a metallic material, such as at least aluminum.

The EGR valve 1 may include: a first inlet 9 through which fresh air is introduced from an air cleaner; and a second inlet 11 to which an EGR pipe is connected and through which EGR gas is introduced. The EGR valve 1 may be configured to adjust the amount of the EGR gas that is mixed with the fresh air based on the opening degree of a valve flap 13 and discharge a mixture gas through an outlet thereof, wherein the discharged gas may be supplied to the compressor 3 through the compressor inlet pipe 5. The compressor inlet pipe 5 may include a blow-by nipple 15 integrated therewith to be supplied with blow-by gas through the blow-by nipple.

Therefore, during engine operation, blow-by gas may be supplied from an engine to the compressor inlet pipe 5 through the blow-by nipple 15, and may be compressed by the compressor 3 in the state in which the blow-by gas is mixed with fresh air and an ERG gas, which have passed through the EGR valve 1. For reference, a fluid compressed by the compressor 3 is a mixture in which the ERG gas or the blow-by gas is mixed with air supplied from the air cleaner, and thus is not accurately described as pure air. Therefore, the term "gas" is used to signify that the fluid compressed by the compressor 3 is a mixture fluid which contains the EGR gas, the blow-by gas or the like.

Further, in the present disclosure, the term "charger" is used with a meaning including both a turbocharger, which is driven using exhaust gas discharged from an engine, and a supercharger, which is driven using a separate power source such as a motor. This is for the purpose of indicating that both the turbocharger and the supercharger drive a compressor to compress air suctioned into an engine, differing only in the driving power source, and thus the present disclosure is applicable both to the turbocharger and to the supercharger.

As illustrated in FIGS. 4 to 8, the gas pocket 7 of the compressor inlet pipe 5 may be formed to have a cylindrical space which extends in the longitudinal direction of the compressor inlet pipe 5 while surrounding the outer circumferential surface of the compressor inlet pipe 5. Therefore, a gas supplied to the gas pocket 7 may transfer heat to the compressor inlet pipe 5 due to being in contact with a comparatively wide area of the compressor inlet pipe 5 while surrounding the compressor inlet pipe 5.

A rubber hose 17 may be interposed between the compressor inlet pipe 5 and the EGR valve 1. In other words, the compressor inlet pipe 5 may be directly connected to the EGR valve 1, or, as illustrated in the drawings, may be connected to the EGR valve 1 through the rubber hose 17 from the aspect of ease of assembly or the like. Even in this case, the section of the compressor inlet pipe 5 that is connected to the rubber hose 17 is comparatively short, and thus heat transferred from the gas through the compressor inlet pipe 5 may prevent freezing from occurring inside the EGR valve 1.

When the compressor inlet pipe 5 is directly connected to the EGR valve 1, the heat of the compressor inlet pipe 5 may be better transferred to the EGR valve 1. The gas supply device may include: a gas supply pipe 19 that connects the outlet of the compressor 3 to the gas pocket 7; and a supply valve 21 installed to adjust the opening degree of the gas supply pipe 19. The supply valve 21 may be operated by a controller 23 configured to measure an outside temperature using an outside temperature sensor.

In other words, when the outside temperature measured by the outside temperature sensor is equal to or less than a predetermined reference temperature which is estimated to cause freezing inside the EGR valve 1, the controller 23 may be configured to operate the supply valve 21 to introduce some of gas heated during the compression process in the compressor 3 into the gas pocket 7 through the gas supply pipe 19 and heats the compressor inlet pipe 5. The reference temperature may be configured with reference to a temperature at which freezing of the inside or the like of the EGR valve 1 may be prevented only by supplying a gas to the gas pocket 7 and heating the gas, and may be, for example, about 0° C. or the like.

Figure 9:
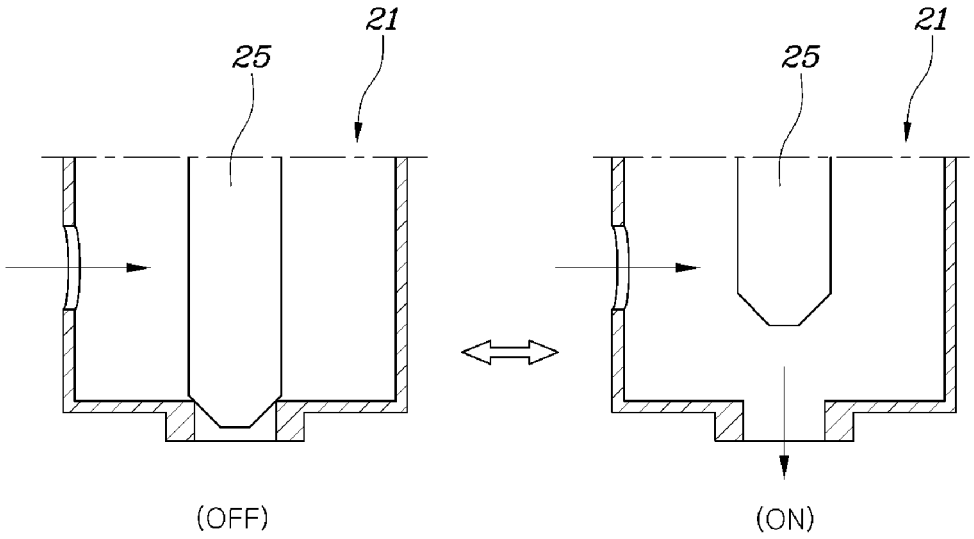
FIG. 9 illustrates a comparison between operations of a supply valve according to the present disclosure.

FIG. 9 illustrates a comparison between on/off states of the supply valve 21. When the controller 23 turns on the supply valve 21 which is in an off-state, a plunger 25 disposed in the supply valve 21 opens a passage while moving to allow a gas to be supplied to the gas pocket 7 through the gas supply pipe 19. The gas discharge device may include a pressure valve 27 installed to discharge a gas in the gas pocket 7 when the inner pressure of the gas pocket 7 is equal to or greater than a predetermined reference pressure. In other words, the gas discharge device is configured such that, when the pressure of gas supplied to the gas pocket 7 through the supply valve 21 and the gas supply pipe 19 is equal to or greater than the reference pressure, as described above, the pressure valve 27 may opened by the pressure of the gas to discharge the gas in the gas pocket 7.

Figure 10:
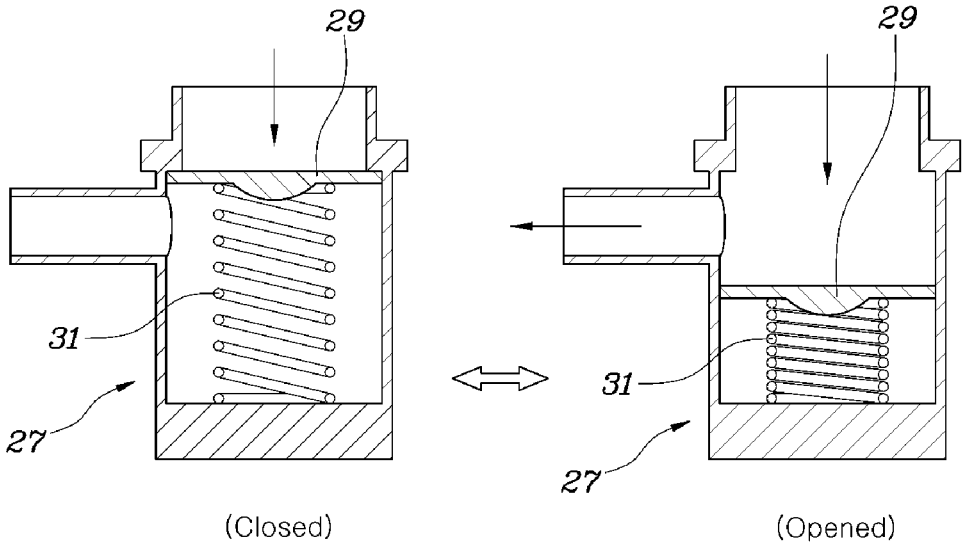
FIG. 10 illustrates a comparison between operations of a pressure valve according to the present disclosure.

FIG. 10 illustrates a comparison between closed/opened states of the pressure valve 27 described above. When a spool 29 disposed in the pressure valve 27 moves while compressing a return spring 31 using the pressure of gas, the pressure valve 27 may be opened to discharge the gas that is in the gas pocket 7. Therefore, a reference pressure at which the pressure valve 27 is opened may be adjusted by the return spring 31, and thus it is preferable to appropriately configure, through multiple experiments and analyses, the reference pressure at a pressure level at which the gas in the gas pocket 7 may be discharged after an appropriate heat transfer time elapses such that excessive pressure is not maintained in the gas pocket 7.

Figure 11:
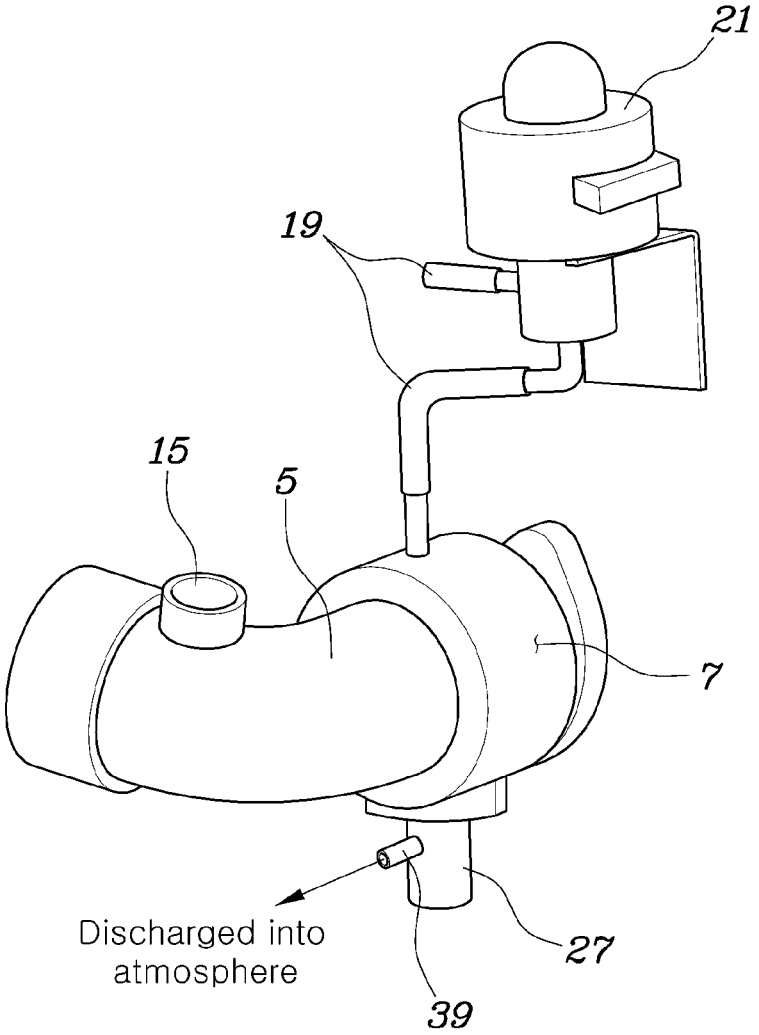
FIG. 11 illustrates a modified example of the present disclosure.

The gas discharged through the pressure valve 27, as described above, may be emitted into the atmosphere as it is, as in a modified example of FIG. 11. However, in the present exemplary embodiment, as illustrated in FIG. 1, the engine intake system may further include a gas recovery pipe 33 installed to supply gas discharged by the pressure valve 27 to an inlet of an intercooler, whereby the gas discharged from the pressure valve 27 may be supplied to an engine via the intercooler without being emitted into the atmosphere, and thus EGR gas or blow-by gas contained in the gas may be prevented from being emitted into the atmosphere.

An intercooler inlet hose 35 and an intercooler inlet pipe 37 may be connected to the outlet of the compressor 3 in sequence, and the gas recovery pipe 33 may be connected to the intercooler inlet pipe 37. Of course, the intercooler inlet pipe 37 may be connected to the intercooler (not shown) to cool a gas heated during the compression process in the compressor 3 and supply the cooled gas to a combustion chamber of the engine. In the present exemplary embodiment, the compressor inlet pipe 5 may be formed in an L-shape with a first end thereof connected to a compressor 3 housing and a second end thereof connected to the EGR valve 1 via the rubber hose 17, and thus enabling a compact engine intake system to be configured. The engine intake system of the present disclosure, configured as described above, may be driven in the three modes shown in the following table.

| | Supply valve | Pressure valve | Content |
|---|---|---|---|
| First mode | OFF | OFF | Outside temperature is equal to or greater than reference temperature. This mode is a noimal charging mode, and high-temperature charging gas is not introduced into a gas pocket. |
| Second mode | ON | OFF | Outside temperature is less than reference temperature. High-temperature charging gas is introduced into a gas pocket, and the gas pocket is charged with the high-temperature charging gas. |
| Third mode | ON | ON | When the pressure of gas in a gas pocket is equal to or greater than reference pressure, a pressure valve is opened to discharge the gas to an intercooler, and introduce new gas into the gas pocket. |

The above-described engine intake system of a vehicle according to the present disclosure may be implemented as follows. In other words, an engine intake system of a vehicle according to the present disclosure may include: an EGR valve 1, which includes a first inlet 9 through which fresh air is introduced, a second inlet 11 through which EGR gas is introduced, an outlet through which gas obtained by mixing the fresh air and the EGR gas is discharged, and a valve flap 13 configured to adjust the amount of the EGR gas that is mixed with the fresh air; a compressor inlet pipe 5 installed to supply a compressor 3 with the gas discharged from the outlet of the EGR valve 1; and a heater configured to heat the compressor inlet pipe 5 using a gas compressed and discharged by the compressor 3.

The heater may include: a gas pocket 7 provided at the compressor inlet pipe 5; and a gas supply pipe 19 configured to supply the gas pocket 7 with the gas compressed and discharged by the compressor 3. The engine intake system of the present disclosure may further include: a supply valve 21 configured to regulate the gas supplied to the gas pocket 7 through the gas supply pipe 19; and a controller 23 configured to operate the supply valve 21 based on the temperature outside the vehicle to prevent the EGR valve 1 from freezing.

A pressure valve 27 may be connected to the gas pocket 7 and may be opened when the gas pressure inside the gas pocket 7 is equal to or greater than a predetermined reference pressure. The pressure valve 27 may include a discharge port 39 through which a discharged gas is emitted into the atmosphere. Further, a gas recovery pipe 33 may be connected to the pressure valve 27 to supply a discharged gas to an intercooler.

Although the present disclosure has been described and illustrated with reference to particular exemplary embodiments thereof, it will be apparent to a person skilled in the art that various improvements and modifications to the present disclosure can be made without departing from the technical idea of the present disclosure, which is set forth in the following claims.

What is claimed is:

1. An engine intake system of a vehicle, comprising:

a compressor inlet pipe, which is installed to connect an exhaust gas recirculation (EGR) valve to an inlet of a compressor of a charger and is made of a thermally conductive material;

a gas pocket formed at the compressor inlet pipe;

a gas supply device configured to draw a gas from an outlet of the compressor of the charger and supply the gas to the gas pocket; and a gas discharge device configured to discharge the gas in the gas pocket.

2. The engine intake system of claim 1, wherein the compressor inlet pipe includes a blow-by nipple formed integrally therewith to be supplied with a blow-by gas through the blow-by nipple.

3. The engine intake system of claim 1, wherein the gas pocket of the compressor inlet pipe is formed to have a cylindrical space extending in a longitudinal direction of the compressor inlet pipe while surrounding an outer circumferential surface of the compressor inlet pipe.

4. The engine intake system of claim 1, wherein a rubber hose is interposed between the compressor inlet pipe and the EGR valve.

5. The engine intake system of claim 1, wherein the gas supply device includes:

a gas supply pipe that connects the outlet of the compressor to the gas pocket; and a supply valve installed to adjust an opening degree of the gas supply pipe.

6. The engine intake system of claim 1, wherein the gas discharge device includes a pressure valve installed to discharge a gas in the gas pocket when an inner pressure of the gas pocket is equal to or greater than a predetermined reference pressure.

7. The engine intake system of claim 6, wherein the gas discharge device further includes a gas recovery pipe installed to supply the gas discharged by the pressure valve to an inlet of an intercooler.

8. The engine intake system of claim 7, wherein an intercooler inlet hose and an intercooler inlet pipe are connected to the outlet of the compressor in sequence and the gas recovery pipe is connected to the intercooler inlet pipe.

9. The engine intake system of claim 1, wherein the compressor inlet pipe is formed in an L-shape with a first end connected to a compressor housing and a second end thereof connected to the EGR valve via a rubber hose.

10. An engine intake system of a vehicle, comprising:

an exhaust gas recirculation (EGR) valve including a first inlet through which fresh air is introduced, a second inlet through which an EGR gas is introduced, an outlet through which a gas obtained by mixing the fresh air and the EGR gas is discharged, and a valve flap configured to adjust an amount of the EGR gas that is mixed with the fresh air;

a compressor inlet pipe installed to supply a compressor with the gas discharged from the outlet of the EGR valve; and a heater configured to heat the compressor inlet pipe using a gas compressed and discharged by the compressor.

11. The engine intake system of claim 10, wherein the heater includes:

a gas pocket provided at the compressor inlet pipe; and a gas supply pipe configured to supply the gas pocket with the gas compressed and discharged by the compressor.

12. The engine intake system of claim 11, further comprising:

a supply valve configured to regulate the gas supplied to the gas pocket through the gas supply pipe; and a controller configured to operate the supply valve based on a temperature outside the vehicle to prevent the EGR valve from freezing.

13. The engine intake system of claim 11, wherein a pressure valve is connected to the gas pocket and is opened when a gas pressure inside the gas pocket is equal to or greater than a predetermined reference pressure.

14. The engine intake system of claim 13, wherein the pressure valve includes a discharge port through which a discharged gas is emitted into an atmosphere.

15. The engine intake system of claim 13, wherein a gas recovery pipe is connected to the pressure valve to supply a discharged gas to an intercooler.

* * * * *